United States Patent [19]

Koch

[11] Patent Number: 4,712,413

[45] Date of Patent: Dec. 15, 1987

[54] BILLET HEATING PROCESS

[75] Inventor: Alan A. Koch, Maryland Heights, Mo.

[73] Assignee: Alumax, Inc., San Mateo, Calif.

[21] Appl. No.: 909,554

[22] Filed: Sep. 22, 1986

[51] Int. Cl.[4] ..... B21D 37/16; B21D 43/10

[52] U.S. Cl. ..... 72/361; 72/364; 72/422; 72/342; 164/900

[58] Field of Search ..... 72/342, 361, 364, 422; 164/332, 485, 900; 148/2; 219/7.5, 10.69, 10.71

[56] References Cited

U.S. PATENT DOCUMENTS

| | | | |
|---|---|---|---|
| 3,684,854 | 8/1972 | Nikonov et al. | 219/10.69 |
| 3,902,544 | 9/1975 | Flemings et al. | 164/485 |
| 4,569,218 | 2/1986 | Baker et al. | 72/342 |

FOREIGN PATENT DOCUMENTS

| | | |
|---|---|---|
| 1129624 | 8/1982 | Canada . |
| 1136679 | 11/1982 | Canada . |
| 1499934 | 2/1978 | United Kingdom . |

OTHER PUBLICATIONS

M. C. Flemings, R. G. Riek, K. P. Young, "Rheocasting," *Materials Science and Engineering,* vol. 25, (1976), pp. 103–117.

G. B. Brook, "Improving the Quality of Aluminum Die Castings by Novel Techniques," *Material Design,* Oct., 1982, 3, (5), pp. 558–565.

S. D. E. Ramati, G. J. Abbaschian, D. G. Backman, R. Mehrabian, "Forging of Liquid and Partially Solid Sn–15% Pb and Aluminum Alloys," *Metallurgical Transactions,* vol. 9B, Jun., 1978, pp. 279–286.

*Primary Examiner*—Lowell A. Larson

*Attorney, Agent, or Firm*—Malcolm B. Wittenberg

[57] ABSTRACT

Shaped metal parts are produced on a continuous basis from semi-solid metal preforms. The preforms are supported on pedestals which are surrounded by a ring of material which acts as a heat sink to absorb heat from the liquid portion of the preforms to substantially solidify the liquid portion and prevent the preforms from losing liquid to runoff.

19 Claims, 7 Drawing Figures

BILLET HEATING PROCESS

TECHNICAL FIELD OF THE INVENTION

The present invention relates to an apparatus for producing shaped metal parts on a continuous basis. The invention is related to the invention disclosed and claimed in U.S. Pat. No. 4,569,218 and is considered an improvement over the invention disclosed therein.

BACKGROUND OF THE INVENTION

Vigorous agitation of metals during solidification is known to eliminate dendritic structure and produce a semi-solid "slurry structured" material with thixotropic characteristics. It is also known that the viscosities of such material may be high enough to be handled as a soft solid. See Rheocasting, Merton, C. Flemings, and Kenneth P. Young, McGraw, Hill, *Yearbook of Science and Technology,* 1977–78. However, processes for producing shaped parts from such slurry structured materials, particularly on a continuous basis, present a number of problems. Such processes require a first step of reheating a slurry structured billet charge to the appropriate fraction of solid and then forming it while in a semi-solid condition. A crucible has been considered essential as a means of containing the material and handling it from its heating through its forming cycle. The use of such crucibles is costly and cumbersome, and furthermore, creates process disadvantages such as material loss due to crucible adhesion, contamination from crucible degradation and unwanted chilling from random contact with crucible sidewalls. Further problems are involved in the heating, transport and delivery of billets which are in a semi-solid condition.

Recognizing that it would be desirable to provide an apparatus and process for producing shaped metal parts from semi-solid preforms, the invention disclosed in U.S. Pat. No. 4,569,218 was made. In accordance with that invention, it was found that it is possible to produce on a continuous basis shaped metal parts from slurry structured freestanding metal preforms by sequentially raising the heat content of the preforms as they pass through a plurality of induction heating zones. The heating sequence is such that it somewhat avoids melting and resulting flow and permits thermal equilibration during transfer from one zone to the next as the preforms are raised to a semi-solid temperature. The invention further provides that the preforms take on the characteristic of being substantially uniformly semi-solid throughout their bodies. The freestanding semi-solid preforms are taught to be transferred to a press or other shaping station by means of a mechanical device which grips the preforms with a very low force, which both prevents substantial physical deformation of the semi-solid preform and reduces heat loss. As a preferred embodiment, U.S. Pat. No. 4,569,218 further teaches that the transfer means may be heated to even further minimize heat loss of the preforms during transfer.

More specifically, the apparatus disclosed in the above-referenced patent comprises, in combination, means for supporting and positioning a plurality of slurry structured freestanding metal preforms which include means for passing the preforms through a plurality of induction heating zones containing induction heating means for sequentially raising the heat content of the preforms while the preforms remain freestanding to a level at which the preforms are semi-solid. Means are then provided for transferring the freestanding preforms from the supporting means to a shaping means while the preforms remain in a semi-solid state, said transfer occurring without substantial deformation of the preforms and without substantial local variation in fraction solids within the preforms. Means are then provided for shaping the preforms while in the semi-solid state into a shaped metal part and means for recovering the solidified shaped metal part.

Although the invention disclosed and claimed in U.S. Pat. No. 4,569,218 is adequate, particularly when dealing with semi-solid preforms of rather small mass, as preform sizes have increased to produce larger and larger shaped metal parts, it was noted that the semi-solid preforms tend to excrete liquid metal. This tendency is particularly noticeable as the preforms pass through multiple induction heating zones and approach the appropriate temperature for shaping into the final metal parts. The loss of liquid can be related to the degree of melting which is induced by the induction heating elements and appears to be relatively unrelated to the rate of heating. Typically, a 1 kg slug of aluminum alloy 357, being of a cylindrical configuration and having a diameter of approximately 2.5" and a length of approximately 5" would lose from 50 to 100 grams of liquid when heated an appropriate amount for shaping into a forged part. This results in upwards of a 10% metal loss. Besides losing a significant portion of each preform, the liquid which emanates from each preform accumulates on the processing equipment, which must be cleaned after each cycle and results in operational inefficiencies.

In an attempt to eliminate liquid loss from each preform, U.S. application Ser. No. 883,324, filed on July 8, 1986, taught the use of a can-shaped containment means for holding the preform on the pedestal while the preform was being subjected to its induction heating sequence. Although this represents a marked advance in the art, the invention disclosed and claimed in the referenced co-pending application is not without its own deficiencies. Great care must be taken to ensure the fact that the can remains substantially transparent to the inductive heating means. Furthermore, the process for producing shaped metal parts must account for each can, either by depositing the cans in the shaping means, which results in can destruction and resultant increased process costs, or in can retrieval, resulting in additional processing steps, which in turn adds to the cost of the overall process.

It is thus an object of the present invention to provide an apparatus and method related to the invention disclosed and claimed in U.S. Pat. No. 4,569,218 while avoiding the metal loss referred to above.

It is yet another object of the prevent invention to provide an apparatus capable of forming shaped metal parts from semi-solid preforms without significant metal loss and without the use of can containment means disclosed in the above-referenced co-pending application.

The accomplishment of these objects will be more readily appreciated when considering the following disclosure and appended drawings, wherein FIG. 1 is a partially schematic plan view of one embodiment of the apparatus useful in the practice of the present invention;

SUMMARY OF THE INVENTION

Figure 1:
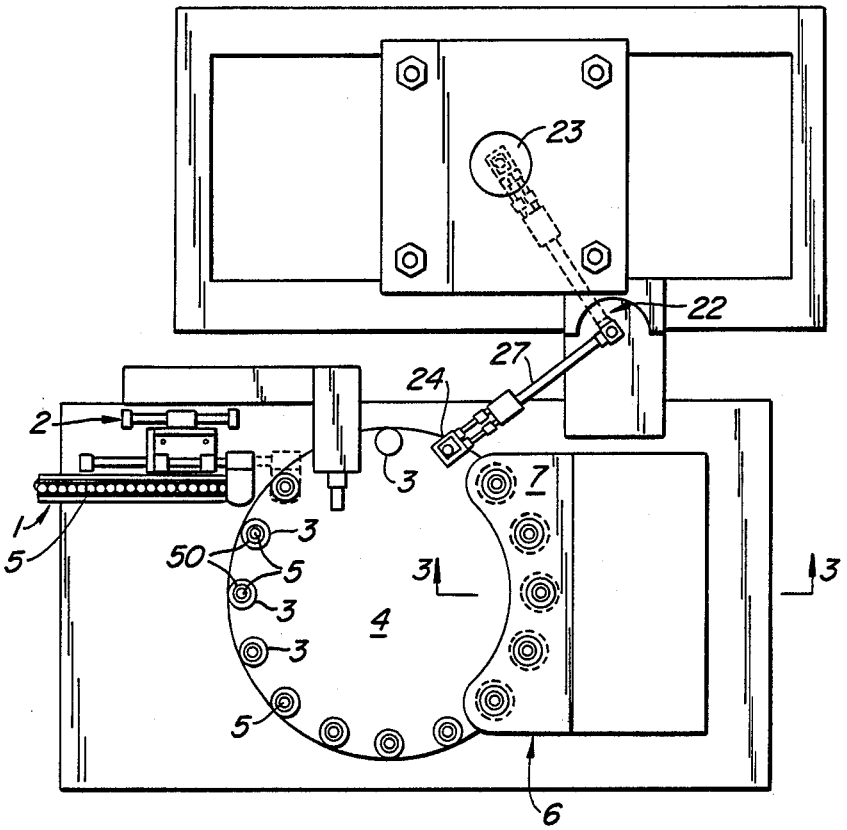

The present invention involves an apparatus and method of using said apparatus for continuously producing shaped metal parts. The apparatus comprises means for supporting and positioning a plurality of free-standing metal preforms. Included within the apparatus is heating means as well as means for indexing the preform sequentially through said heating means. The heating means comprise a plurality of separate partitioned heating stations for sequentially raising the heat content of the preforms as the preforms pass in and out of each of the heating stations. The preforms remain free-standing while being heated within the heating stations to a level at which the preforms become partially liquid and partially solid. Means are provided for transferring the free-standing preforms from the supporting means to a shaping means while the preform remains substantially in its initial shape, being partially liquid and partially solid. Means are provided for shaping the preform while partially liquid and partially solid into a shaped metal part. Means are provided for recovering the preform after being solidified to the metal part.

The improvement embodied by the present invention comprises providing a ring of material around the means for supporting the preforms. The ring acts as a heat sink to absorb heat from the liquid portion of the preforms to substantially solidify its liquid portion and substantially prevent the preforms from losing the liquid to runoff.

DETAILED DESCRIPTION OF THE INVENTION

The starting preform used in the practice of the present invention is a metal alloy, including but not limited to such alloys as aluminum, copper, magnesium or iron, which has been prepared in such a fashion as to provide a slurry structure. This may be done by vigorously agitating the alloy while in the form of a liquid-solid mixture to convert a substantial portion, preferably 30%–55% by volume of the alloy to a non-dendritic form. The liquid-solid mixture is then cooled to solidify the alloy. Alloys of this nature are generally characterized as possessing a microstructure which, upon reheating to a semi-solid state, contain primary spherical solid particles within a lower melting matrix.

Such slurry structured materials may be prepared without agitation by a solid state process involving the production, such as by hot working, of a metal bar or other shape having a directional grain structure and a required level of strain introduced during or subsequent to hot working. Upon reheating such a bar, it will also contain primary spherical solid particles within a lower melting matrix. Yet another method of forming the slurry structured materials by agitation is by use of a rotating magnetic field, such as that disclosed in published British application No. 2,042,386. A preferred method of preparing the preforms is, however, by the solid state process which is disclosed more fully in U.S. Pat. No. 4,415,374, the disclosure of which is incorporated by reference herein.

An apparatus and process for producing shaped metal parts related the present invention is taught in U.S. Pat. No. 4,569,218. The invention disclosed in the referenced patent is taught to be particularly useful for the production of relatively small shaped copper or aluminum alloy parts. It was recognized that beyond a certain size, free-standing preforms become increasingly difficult to handle in a semi-solid condition and, as such, the invention was deemed useful only in the production of relatively small parts. Through the practice of the present invention, however, the size of the preform and resulting finished product is no longer seen as a limiting variable.

Figure 5:
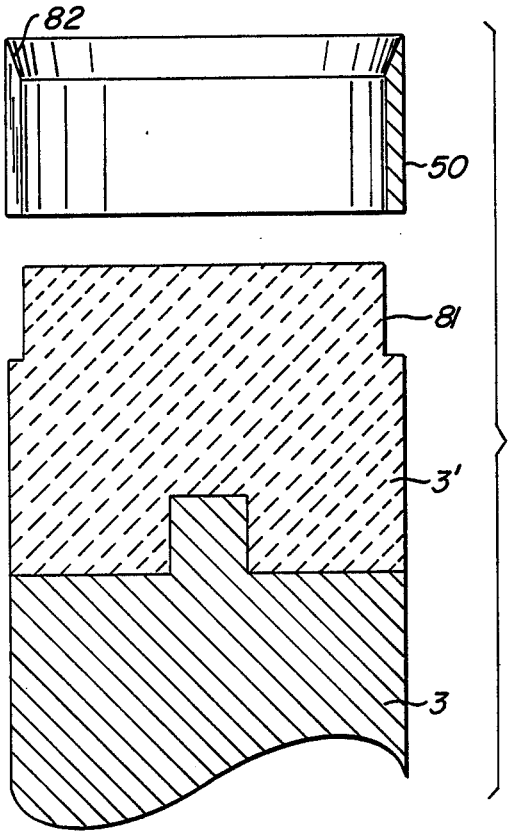
FIG. 5 is a cross-sectional view of the details of a typical pedestal and ring of material prior to its placement on said pedestal.

To eliminate the above-referenced difficulties, the apparatus and process described and claimed in U.S. Pat. No. 4,569,218 have been modified by the inclusion of a ring of material 50 intended to surround and fit onto thermal insulator cap 3', which in turn is located upon pedestal 3 (FIG. 5).

As shown in FIG. 1, preform slugs are fed into a stacker 1 as, for example, from a commercially available vibratory bowl feeder (not shown). The metal preforms are placed upon insulator caps 3', which have already been configured with rings 50. The preforms are generally lifted by a loading dial 2 and placed upon thermal caps 3' on rotatable table 4. The rotatable table contains, around its periphery, a series of such pedestals and insulator caps, each of which supports and positions a free-standing preform or slug 5.

Figure 4:
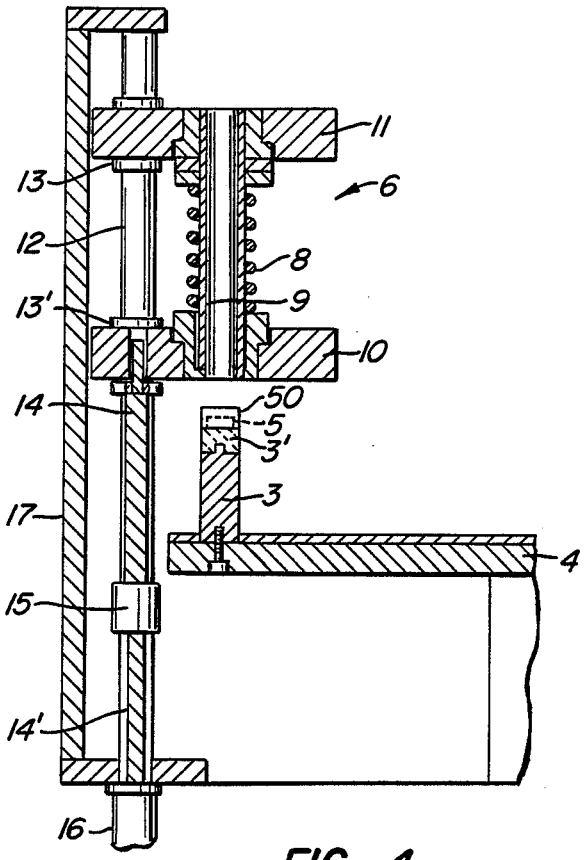
FIG. 4 is a cross-sectional view of the induction heater in an elevated position above the preform and surrounding ring taken along lines 3—3 of FIG. 1.

An induction heater 6 is mounted on an opposite side of rotatable table 4, the induction heater comprising a hood 7 containing a series of coils forming a series of induction heating zones. The induction heater is vertically movable from a first elevated position, as shown in FIG. 4, when table 4 is in the process of being indexed to the next consecutive pedestal position to a second descended position in which the induction heating zone encloses a series of adjacent preforms surrounded by rings 50 so as to raise the heat content of the metal preforms. During this period, the horizontal center line of the preform should be below the center line of the coils of the induction heater to avoid levitation of the preforms. Each of the induction heating zones heats the adjacent preforms to a sequentially higher level in the direction of movement of table 4 so that the preform about to emerge from the induction heater, i.e., in its final position in the heater, is in a uniformly semi-solid condition, preferable 70–90% by volume solids, remainder liquid. In the invention taught in U.S. Pat. No. 4,569,218, it was recited to be necessary to provide a specific relationship between the rate of heating wherein the various induction coil members as the preforms approach their final softened state to avoid liquid metal flow problems. However, through the use of the present invention, it is substantially unnecessary to shorten the total time at final temperature, as the liquid flow would simply be solidified by the rings as contact is made between the liquid metal and the inner ring surface to substantially eliminate liquid loss.

The ring of the present invention can typically be comprised of any material having sufficient thermal mass to absorb the latent heat of fusion of the liquid alloy runoff and which preferably would not interfere with the induction heating process. Typically, such materials include copper, stainless steel, and even non-metals such as $SiN_4$, with copper being the preferred material.

In light of the fact that the ring of the present invention is intended to act as a "heat sink" for solidifying liquid preform metal to prevent its runoff, the mass and size of the ring will depend upon the alloy composition, i.e., its heat of fusion, as well as the anticipated volume of liquid to be solidified. In principle, the ring will continue to function as a "heat sink" until it reaches the temperature of the liquid metal. For a copper ring, the heat absorption capacity (thermal mass) is a function of the specific heat of copper and mass of the ring. Since the specific heat of copper is about 0.12 calories per $gm^{-1}$ per $°C.^{-1}$, for an aluminum alloy runoff at a temperature of about 560° C. which is typical of such a process, each gram of copper can absorb (560°-20° C.) (0.12) calories, increasing its temperature from 20° C. to 560° C. The thermal mass is this number times the mass of the ring which, for a typical ring for a two-pound slug, weighs approximately 100 grams. The maximum usable thermal mass is therefore approximately 64,800 calories. The heat which must be absorbed is a function of the mass of the liquid runoff times latent heat of fusion, which is approximately 95 cal. $gm^{-1}$. Assuming 50 grams of runoff which is fully liquid, the heat to be absorbed is approximately (50)(95)=4750 calories. This calculation can be used in selecting the appropriate ring mass for any particular alloy useful in practicing the present invention.

Although there is a great deal of discretion available in the placement of the ring upon the pedestal, it is preferred that ring 50 be placed upon thermal insulator cap 3' by fitting ring 50 onto lip of reduced diameter 81 such that only a portion of ring 50 such as chamfered surface 82 extend above the top surface of the pedestal's insulator cap. This is found sufficient to provide the necessary heat transfer surface to solidify liquid runoff and prevent its escape. As a further preferred embodiment, it was found that a coating of graphite available from Miracle Power Products Corp. under the trademark "$dgf_{123}$" can be sprayed upon chamfered surface 82 or any surface which is intended to contact the preform liquid runoff. The graphite coating aids in freeing any solidified metal from sticking to the chamfered edge, since it is a non-wetting coating, and it also serves to increase the heat radiated from the ring between heating cycles by increasing the emissivity of the ring.

It is recognized that the wall thickness of the ring must be sufficiently thin to pose no substantial electrical load to the induction field. A ring having a relatively thin cross-section of electrically conductive material, such as copper, poses little load to the heating coils and poses an insignificant effect on the preform heating process. Typically, when using rings of copper, sidewall thicknesses of between approximately 0.075 to 0.125 inches are contemplated where the ring sidewall height is approximately one inch in length. Again continuing the typical example, such a ring would be placed around thermal insulator cap 3' such that approximately ¾ of an inch of the ring surrounds indented area 81 while chamfered region 82 extends approximately ¼ of an inch above the top surface of element 3'

Figure 6:
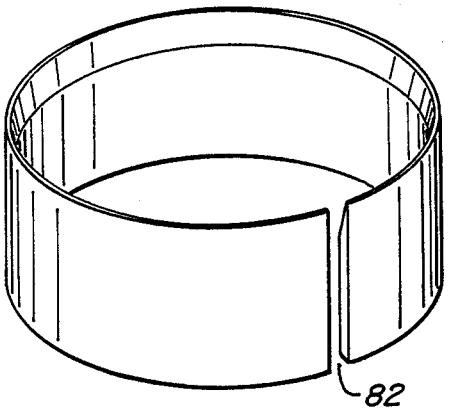
FIGS. 6 and 7 are two prospective views of rings contemplated for use in practicing the present invention.
Figure 7:
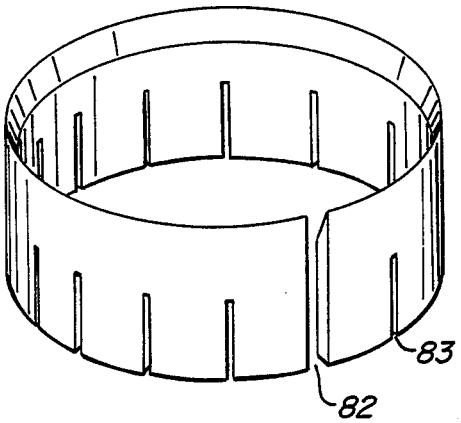

As a further improved embodiment, as shown in FIGS. 6 and 7, the ring can be provided with slit 82, alone, or with louvers 83. Slit 82 comprises a single continuous cut through the entire body sidewall of the ring while louvers 83 comprise a number of cuts made partially through the body of the sidewall of the ring. Slit 82 is intended to reduce any eddy current heating effects which may be presented by the induction heater while the louvers 83 would provide the additional function of enhancing the ring's ability to radiate heat to provide a more efficient heat transfer member. It is further contemplated that the ring be capable, in a preferred embodiment, to be removable from the pedestal or its thermal insulator cap 3'. This would enhance the ability to clean the ring and the surrounding surfaces during processing runs.

Turning again to the appended figures, the induction heater is shown in greater detail in the cross-sectional view of FIG. 4. As there shown, the induction heater 6 comprises series wound induction coil 8, having a ceramic liner 9 mounted in a phenolic rack having a bottom support 10 and a top support 11. The heater 6 is in turn mounted for vertical movement on a post 12 via bearings 13 and 13'. Extension rods 14 and 14' are coupled through coupler 15 to an air cylinder 16 for raising and lowering the induction heater 6 about preform 5. The entire assembly is mounted in a frame 17.

Figure 2:
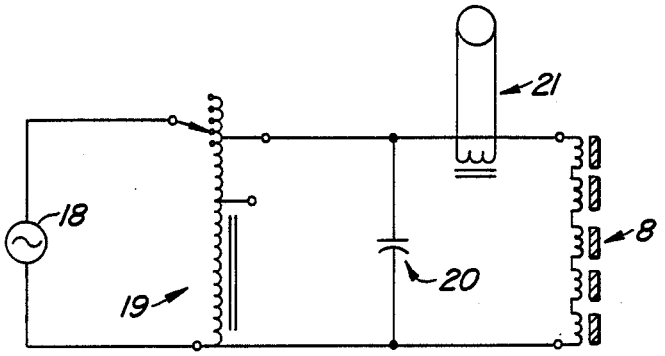
FIG. 2 is a diagram of an electrical circuit for the induction heater shown in FIGS. 1 and 4.
Figure 3:
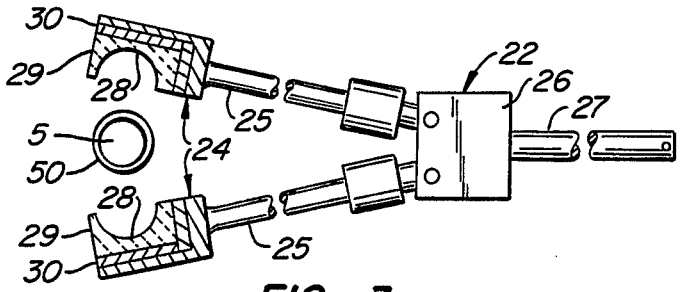
FIG. 3 is an enlarged plan view of the mechanical gripper shown in FIG. 1.

A typical circuit diagram for the induction heater 6 is shown in FIG. 2. As there shown, a high frequency alternating current power source 18 supplies current through a load station consisting of a primary transformer 19, parallel tuning capacitors 20, and an output current transformer 21 to the induction heater 6, comprising five induction coils 8 connected in series. Direct-current heating is also contemplated as an appropriate mode of raising the temperature of preform 5.

After the table is indexed, the preform, surrounded by the ring, is moved from its final position in the heater to a first position external the heater. The ring can be removed prior to removal of the preform or can remain in place and the preform be lifted from the top surface of the pedestal by a pair of grippers 22, which mechanically grip and remove the preform and which rotate to a position aligned with a die of a press 23. At that point, grippers 22 can be actuated to open, thereby releasing the preform onto the plates of the press.

Grippers 22 comprise a pair of gripping jaws 24, preferably containing electrical resistance heating means embedded therein. The gripper jaws are attached to gripper arms 25 which are pivotally mounted for adjustment of the distance therebetween on a gripper actuator 26 which may be an air-powered cylinder. The actuator is, in turn, pivotally mounted on a suitable support through an actuator arm 27 for transferring the preforms from table 4 to press 23. The surface 28 of the gripper jaws can be machined from a refractory block 29 to have a contour closely matching the contour of the semi-solid preform 5. A thermal barrier 30 can be sandwiched between block 29 and gripper jaw 24. Embedded in each of the refractory blocks 29 can be located an electrical resistance heater rod (not shown) which may be suitably connected to an electrical power source. The gripper jaws are heated to minimize the chilling effect of the gripper material on the semi-solid preform. For aluminum alloy preforms, the face of the jaws of the gripper may, for example, be plasma-sprayed alumina or magnesia; for copper alloys, the face may be a mold washed steel refractory coating or high density graphite. The surface of the gripper may be heated to a temperature substantially above room temperature but below the liquidus temperature of the preforms. The gripper surface of the jaw faces should be maximized so as to minimize deformation of the preform, with the gripper jaw's circumference and radius of curvature being close to that of the preform.

Press 23 can comprise any well-known device for shaping metal parts, as taught in the prior art. For example, the press may be hydraulic, ranging from 1–500 tons, equipped with dies appropriate to the part being shaped. The press may be actuated by a commercially-available hydraulic pump sized to meet the tonnage requirements of the system. Suitable times, temperatures and pressures for shaping parts from slurry-structured metals are disclosed in Canadian Pat. No. 1,129,624, issued on Aug. 17, 1982.

The induction heating power supply for the system may range in size from 1–1000 kw and may operate at frequencies from 60–400,000 Hz. The precise power capability and frequency are selected in accordance with the preform diameter, heating rate desired, and composition of the ring. Typically, for example, the power requirement may range from ¼ to 1 kw per pound per hour of production required. As alluded to previously, the physical dimension of the ring is made with the electrical resistivity and magnetic permeability of the ring material and frequency of the induction heating means as variables. As such, it is generally believed that ring wall thicknesses which are somewhat "transparent" to the induction heating means when the ring surrounds the appropriate preform ingot to be heated are governed by the following relationship:

$$\text{Maximum wall thickness } \delta = 3160\sqrt{\frac{P}{\mu_r f}} \text{ inches}$$

Where

P=electrical resistivity in ohm - inches $\mu_r$=relative magnetic permeability f=frequency in cycles/sec.

For a copper ring, the optimum wall thickness was calculated as being approximately 0.083 inches or less in a 1000 Hz field.

EXAMPLE I

A 357 aluminum alloy preform slug weighing 586 grams and having the dimensions of a 2 inch diameter by 4.25 inch height was loaded onto a platform and subjected to an induction coil array operating at 1,000 Hz. Four fast heating cycles and six slow rate heating cycles were employed, each cycle being of 35 seconds duration with a transfer time of 5 seconds between heating cycles. A power supply was used, operating at 955 amps. Although parts of good quality were achieved, it was noted that an average of 7.5 to 11.5 grams of liquid loss was experienced from each preform.

EXAMPLE II

The above-recited example was repeated with the exception that a ring composed of copper was fitted about each pedestal prior to the loading of the preform slug. The rings were 1 inch in height, having a wall thickness of 0.125 inches and an outside diameter of 2.5 inches. Each ring was configured with a slit as shown in FIG. 6. Although each of the preform slugs was heated per the above-recited regime, no alloy liquid was lost during or subsequent to the sequential heating steps. It was noted that the copper rings heated to approximately 460° F. during the heating sequence and each cooled to approximately 430° F. within one minute after the preform slugs were removed for part formation.

EXAMPLE III

The heating regime employed in Example 1 was duplicated once again. This example differed from the previously-recited experiment in that the pedestal top was heated to provide extreme conditions for testing the efficiency of the ring. It was noted that although the preform slug was too deformed to make a part, less than 5 grams of liquid was lost by the end of the heating cycle. When the ring was removed and the experiment repeated, an average of 47 grams of liquid alloy runoff was measured and, again, the preform was too difficult to handle to make a metal part therefrom.

I claim:

1. In an apparatus for continuously producing shaped metal parts comprising:

means for supporting and positioning a plurality of freestanding metal preforms, heating means, means for indexing said preforms sequentially through said heating means, said heating means comprising a plurality of separate partitioned heating stations for sequentially raising the heat content of said preforms as said preforms pass into and out of each of said heating stations, said preforms remaining freestanding and being heated in said heating means to a level at which said preforms become partially liquid and partially solid, means for transferring freestanding preforms from their supporting means to a shaping means while said preforms remain substantially in their initial shape and partially liquid-partially solid state, means for shaping said preforms while in said partially liquid-partially solid state into shaped metal parts and means for recovering said preforms after being solidified into metal parts, the improvement comprising a ring of material surrounding said means for supporting said preforms, a portion of said ring extending above said means for supporting said preform which acts as a heat sink to absorb heat from the liquid portion of said preforms to substantially solidify said liquid portion and substantially prevent said preforms from losing said liquid to runoff.

2. The apparatus of claim 1 wherein said ring comprises copper.

3. The apparatus of claim 1 wherein said ring is further characterized as being slit through the body thereof to substantially prevent the establishment of a continuous eddy current path in the ring from said heating means.

4. The apparatus of claim 3 wherein said slit comprises a single continuous cut through the entire body side wall of the ring.

5. The apparatus of claim 3 wherein said slit comprises a number of cuts made partially through the body side wall of the ring.

6. The apparatus of claim 1 wherein said ring is of sufficient mass to substantially absorb all of the latent heat of fusion of the liquid preform runoff.

7. The apparatus of claim 1 wherein said ring is provided with a graphite coating on the surface thereof which is intended to contact the preform liquid runoff.

8. The apparatus of claim 1 wherein said supporting means comprises a pedestal having a top surface for supporting said preform.

9. The apparatus of claim 8 wherein said ring is configured to surround said pedestal wherein a portion of said ring extends above said top surface.

10. The apparatus of claim 9 wherein said ring is capable of being freely removable from said pedestal.

11. The apparatus of claim 9 wherein the wall of said ring is chamfered in the region where said ring extends above the top surface of the pedestal.

12. In a process for continuously producing shaped metal parts comprising the steps of:

supporting and positioning a plurality of freestanding metal preforms, indexing said preforms sequentially through a plurality of separate induction heating stations for sequentially raising the heat content of said preforms to a level at which the preforms are partially liquid and partially solid, while the preforms remain freestanding and said preforms pass through each of said heating stations, transferring said freestanding preforms with a mechanical gripper from said supporting means to a shaping means while the preforms remain substantially in their initial shape and partially liquid-partially solid state, shaping said preforms while in said partially liquid-partially solid state into shaped metal parts and recovering said preforms after being shaped into solidified metal parts, the improvement comprising providing a ring of material around said means for supporting said preforms, a portion of said ring extending above said means for supporting said preform which acts as a heat sink to absorb heat from the liquid portion of said preforms to substantially solidify said liquid portion and substantially prevent said preforms from losing said liquid to runoff.

13. The process of claim 12 wherein said ring comprises copper.

14. The process of claim 12 wherein said ring is further characterized as being slit through the body thereof to substantially prevent the establishment of a continuous eddy current path in the ring from said heating means.

15. The process of claim 12 wherein said ring is of sufficient mass to substantially absorb all of the latent heat of fusion of the liquid preform runoff.

16. The process of claim 12 wherein said ring is provided with a graphite coating on the surface thereof which is intended to contact the preform liquid runoff.

17. The process of claim 12 wherein said supporting means comprises a pedestal having a top surface for supporting said preform.

18. The process of claim 17 wherein said ring is configured to surround said pedestal wherein a portion of said ring extends above said top surface.

19. The process of claim 17 wherein the wall of said ring is chamfered in the region where said ring extends above the top surface of the pedestal.

* * * * *